US005287936A

United States Patent [19]

Grimes et al.

[11] Patent Number: 5,287,936

[45] Date of Patent: Feb. 22, 1994

[54] ROLLING CONE BIT WITH SHEAR CUTTING GAGE

[75] Inventors: Robert E. Grimes, Cypress; Danny E. Scott, Houston, both of Tex.

[73] Assignee: Baker Hughes Incorporated, Houston, Tex.

[21] Appl. No.: 830,130

[22] Filed: Jan. 31, 1992

[51] Int. Cl.[5] ..... E21B 10/00

[52] U.S. Cl. ..... 175/331

[58] Field of Search ..... 175/229, 341, 374, 376, 175/431, 426, 414, 428

[56] References Cited

U.S. PATENT DOCUMENTS

| | | | |
|---|---|---|---|
| Re. 32,036 | 3/1984 | Dennis | 175/329 |
| 2,774,571 | 12/1956 | Morlan | 255/347 |
| 3,137,355 | 6/1964 | Schumacher | 175/374 |
| 3,389,761 | 6/1968 | Ott | 175/374 |
| 3,461,983 | 9/1969 | Hudson et al. | 175/375 |
| 3,858,671 | 1/1975 | Kita et al. | 175/410 |
| 3,922,038 | 11/1975 | Scales | 175/374 X |
| 3,948,330 | 4/1976 | Langford, Jr. | 175/339 |
| 4,058,177 | 11/1977 | Langford et al. | 175/374 |
| 4,140,189 | 2/1979 | Garner | 175/329 |
| 4,298,079 | 11/1981 | Norlander et al. | 175/339 |
| 4,301,877 | 11/1981 | Cloud | 175/340 |
| 4,359,335 | 11/1982 | Garner | 75/208 R |
| 4,624,329 | 11/1986 | Evans et al. | 175/374 |
| 4,694,918 | 9/1987 | Hall | 175/329 |
| 4,729,440 | 3/1988 | Hall | 175/107 |
| 4,738,322 | 4/1988 | Hall et al. | 175/329 |
| 4,832,139 | 5/1989 | Minikus et al. | 175/374 |
| 4,940,099 | 6/1990 | Deane et al. | 175/374 |
| 4,984,643 | 1/1991 | Isbell et al. | 175/341 |
| 5,025,874 | 6/1991 | Barr et al. | 175/374 X |
| 5,145,016 | 9/1992 | Estes | 175/331 |

OTHER PUBLICATIONS

"Smith Steerable-Motor Bits on Target for Your Drilling Program," Promotional Brochure, Smith International, Inc.

*Primary Examiner*—Thuy M. Bui
*Assistant Examiner*—Frank S. Tsay
*Attorney, Agent, or Firm*—Felsman, Bradley, Gunter & Dillon

[57] ABSTRACT

A cutter of an earth-boring bit is provided with hard gage inserts that protrude from the gage surface of the cutter to engage the side of the borehole for holding gage. The gage insert has a substantially flat face with sharp cutting edges formed thereon and has cutting surfaces that define a negative rake angle with respect to the sidewall of the borehole that is being sheared by the gage insert. The face, cutting edge, and cutting surface of the gage insert are formed of a super-hard and abrasion-resistant material such as polycrystalline diamond or cubic boron nitride. The body of the insert is formed of a hard, fracture-tough material such as cemented tungsten carbide. The improved gage inserts are secured into sockets in the gage surface of the rolling cone cutter by interference fit. The improved gage inserts provide an actively cutting gage surface that engages the sidewall of the borehole to promote shearing removal of the sidewall material.

16 Claims, 2 Drawing Sheets

ROLLING CONE BIT WITH SHEAR CUTTING GAGE

BACKGROUND OF THE INVENTION

1. Field of the Invention

This invention relates to cutter assemblies for rolling cone earth boring bits, specifically to the hard inserts for use in such cutter assemblies.

2. Summary of the Prior Art

Earth-boring bits of the rolling cone variety rely on the rolling movement of at least one cutter over the bottom of the bore hole for achieving drilling progress. The earth-disintegrating action of the rolling cone cutter is enhanced by providing the cutter with a plurality of protrusions or teeth. These teeth are generally of two types: milled teeth, formed from the material of the rolling cone; and inserts, formed of a hard material and attached to the rolling cone surface.

One measure of a rolling cone earth-boring bit's performance is its ability to "hold gage," or maintain a consistent borehole diameter over the depth or length of the borehole. Maintenance of a consistent borehole diameter expedites and simplifies the drilling process because drill strings may be removed from and inserted into a hole of generally consistent diameter more easily than a borehole of varying diameter. Gage holding ability is of particular importance in directional drilling applications.

To achieve this gage holding ability, the rolling cones of such earth boring bits have been provided with hard inserts on the outermost, or gage, surface of the rolling cones. These gage inserts have functioned primarily as wear pads that prevent the erosion of the gage surface of the rolling cone, thereby permitting the earth boring bit to hold a more consistent gage or borehole diameter. One example of such an insert is disclosed in U.S. Pat. No. 2,774,571, Dec. 18, 1956, to Morlan. Other gage inserts are shown in U.S. Pat. No. 3,137,335, Jun. 16, 1964, to Schumacher; U.S. Pat. No. 3,389,761, Jun. 25, 1968, to Ott; and U.S. Pat. No. 4,729,440, Mar. 8, 1988, to Hall.

Two staggered rows of such gage inserts are disclosed in U.S. Pat. No. 4,343,372, Aug. 10, 1982, to Kinzer. U.S. Pat. No. 4,940,099, Jul. 10, 1990, to Deane et al., discloses alternating polycrystalline diamond and tungsten carbide gage inserts mounted substantially flush with the gage surface of the rolling cone cutter.

The gage inserts described in the above references are passive in operation, that is, they serve only as wear-resistant inserts and are not designed to actively cut the gage of the borehole. Such wear-resistant inserts are susceptible to heat-cracking and spalling in operation, and may fail to provide adequate gage-holding ability. A Smith International, Inc. promotional brochure entitled "Smith Steerable-Motor Bits On Target For Your Drilling Program" discloses chisel-shaped inserts on the gage surface that protrude a great distance from the gage surface. It is believed that these inserts are easily broken due to bending stress present in the inserts because of their extreme protrusion. It is further believed that rounded cutting edges associated with chisel-shaped inserts are susceptible to heat-cracking and spalling similar to wear-resistant inserts. Chisel-shaped inserts also provide less wear-resistance than flat-tipped inserts because only the rounded chisel crest is in tangential contact with the wall of the borehole.

SUMMARY OF THE INVENTION

It is a general object of this invention to provide an earth-boring bit having improved gage-holding ability.

This and other objects are achieved by a cutter provided with hard gage inserts that protrude from the gage surface of the cutter to engage the side of the borehole for holding gage. The gage insert has a substantially flat face with sharp cutting edges formed thereon and has cutting surfaces that define a negative rake angle with respect to the sidewall of the borehole that is being sheared by the gage insert. The face, cutting edge, and cutting surface of the gage insert are formed of a super-hard and abrasion-resistant material such as polycrystalline diamond or cubic boron nitride. The body of the insert is formed of a hard, fracture-tough material such as cemented tungsten carbide. The improved gage inserts are secured into sockets in the gage surface of the rolling cone cutter by interference fit. The improved gage inserts provide an actively cutting gage surface that engages the sidewall of the borehole to promote shearing removal of the sidewall material. Such an improved gage insert provides an earth-boring bit with improved gage-holding ability, and improved steerability in directional drilling operations.

The above and additional objects, features, and advantages of the invention will be apparent from the following detailed description of the invention.

DETAILED DESCRIPTION OF THE INVENTION

Figure 1:
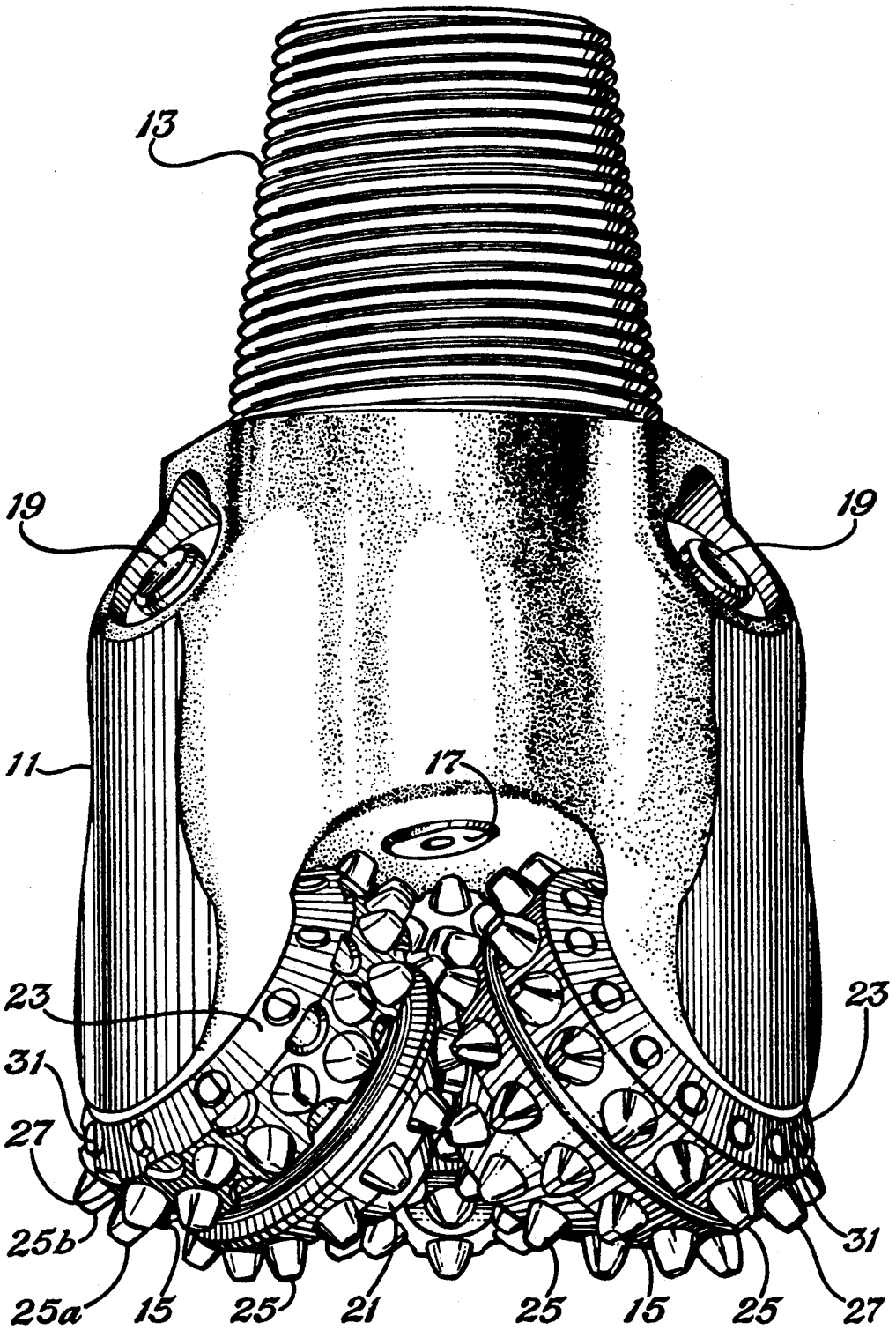
FIG. 1 is a perspective view of an earth-boring bit that embodies the improved gage inserts of the invention.

Referring to FIG. 1, an earth-boring bit 11 has a threaded section 13 on its upper end for securing the bit to a string of drill pipe. A plurality of earth-disintegrating cutters 15, usually three, are rotatably mounted on bearing shafts (not shown) depending from the bit body. At least one nozzle 17 is provided to discharge drilling fluid pumped from the drill string to the bottom of the borehole. A lubricant pressure compensator system 19 is provided for each cutter to reduce a pressure differential between the borehole fluid and the lubricant in the bearings of the cutters 15.

Each cutter 15 is generally conical and has nose area 21 at the apex of the cone, and a gage surface 23 at the base of the cone. The gage surface 23 is frusto-conical and is adapted to contact the sidewall of the borehole as the cutter 15 rotates about the borehole bottom. Each cutter 15 has a plurality of wear-resistant inserts 25 secured by interference fit into mating sockets drilled in the supporting surface of the cutter 15. These wear-resistant inserts 25 are constructed of a hard, fracture-tough material such as cemented tungsten carbide. Inserts 25 generally are located in rows extending circumferentially about the generally conical surface of the cutters 15. Certain of the rows are arranged to intermesh with other rows on other cutters 15. One or two of the cutters may have staggered rows consisting of a first row of 25*a* of inserts and a second row of 25*b* of inserts. A first or heel row 27 is a circumferential row that is closest to the edge of the gage surface 23. There are no inserts closer to the gage surface 23 than the inserts of the heel row 27. On the gage surface 23 of the cutter 15, there is arranged a row of gage inserts according to the present invention.

Figure 2:
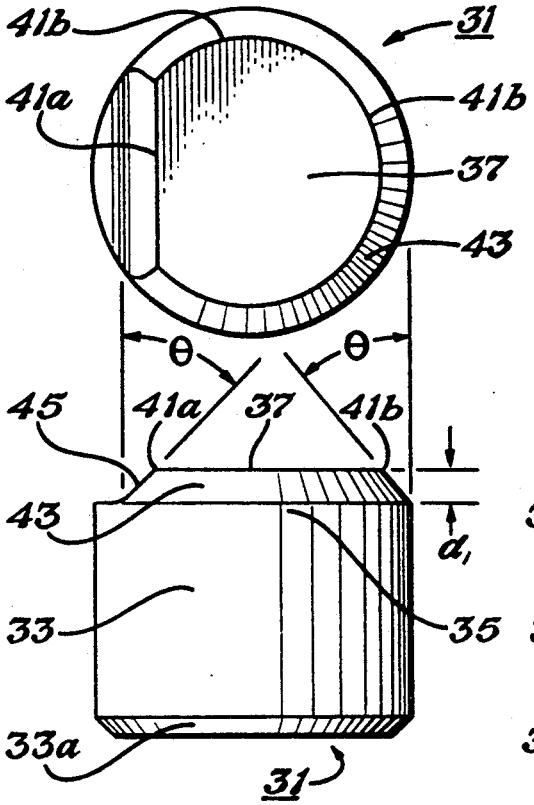
FIG. 2 is an enlarged, plan, and side elevation view of an embodiment of the gage insert of the present invention.
Figure 3:
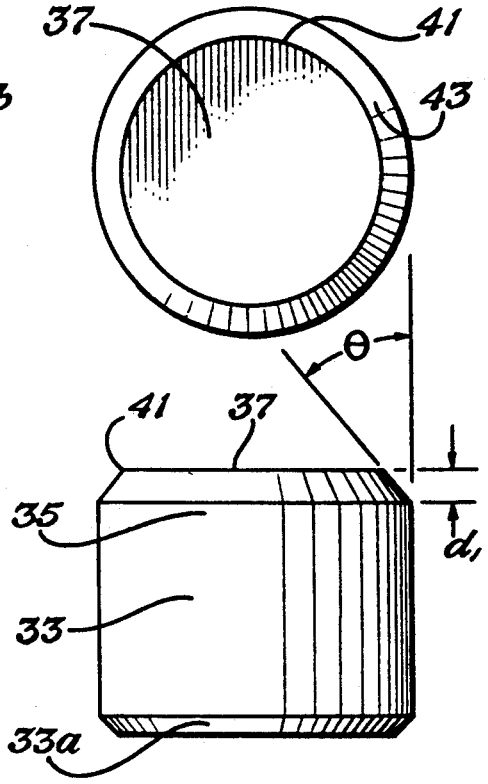
FIG. 3 is an enlarged, plan, and side elevation view of an embodiment of the gage insert of the present invention.

Referring now to FIGS. 2 and 3, enlarged plan and side elevation views of two embodiments of the gage insert of the present invention are shown. Each insert 31 has a generally cylindrical insert body 33, formed of a hard, fracture-tough material such as cemented tungsten carbide or the like. The gage insert 31 has a cutting end 35 having a substantially flat, wear-resistant face 37 formed thereon. The face 37 is substantially normal to the longitudinal axis of the gage insert 31. The cutting end 35 of the gage insert 31 is formed of a layer of a super-hard, abrasion-resistant material such as polycrystalline diamond (PCD), thermally stable polycrystalline diamond (TSP), cubic boron nitride (CBN), or the like. It is at least theoretically possible to fabricate cemented carbide materials having adequate hardness and abrasion resistance for use in the cutting end 35 of the invention, but PCD, TSP and CBN are the only materials presently economically available that are thought to be adequate for use in the cutting end 35. The layer comprising the cutting end 35 of the gage insert 31 may be affixed to the body 33 of the insert 31 by brazing, sintering the two materials together, or other methods well-known in the art. The end of the insert body 33 opposite the cutting end has a small bevel 33*a* formed thereon to facilitate insertion of the insert 31 into the mating hole in the surface of the cutter 15.

At least one cutting edge 41, 41*a*, 41*b* is formed on the cutting end 35 of the gage insert 31. This cutting edge 41, 41*a*, 41*b* may be formed by beveling the circumference of the cutting end 35. Because the cutting end is formed of the super-hard, abrasion-resistant material, likewise the cutting edge 41 also is formed of the super-hard, abrasion-resistant material. It has been found that the cutting edge 41, 41*a*, 41*b* must be formed of a super-hard, abrasion-resistant material for the proper function of the improved gage insert 31. If the cutting edge 41, 41*a*, 41*b* is formed of a softer or less abrasion-resistant material, the cutting edge rapidly will become blunted, and the gage insert 31 will cease to perform effectively as a shear-cutting insert. A blunted cutting edge 41 is equivalent to prior art inserts having radiused or sharp-cornered edges. Prior art PCD flush-mounted inserts are susceptible to heat-cracking and spalling because of excessive friction and heat buildup, and such inserts are incapable of the desirable shear-cutting action of the gage insert 31 of the present invention.

FIG. 2 illustrates an embodiment of the gage insert 31 of the present invention having two cutting edges 41*a*, 41*b*. One of the cutting edges 41*b* is formed by the intersection of a circumferential bevel 43 and the face 37 on the cutting end 35 of the insert 31. The other cutting edge 41*a* is formed by the intersection of a flat or planar bevel 45, the face 37, and the circumferential bevel 43, defining a chord across the circumference of the generally cylindrical gage insert 31. FIG. 3 illustrates an embodiment of the gage insert 31 of the present invention having a single continuous circumferential cutting edge 41 formed by the intersection of a bevel 43 about the circumference of the cutting end 35 of the gage insert 31.

Figure 4:
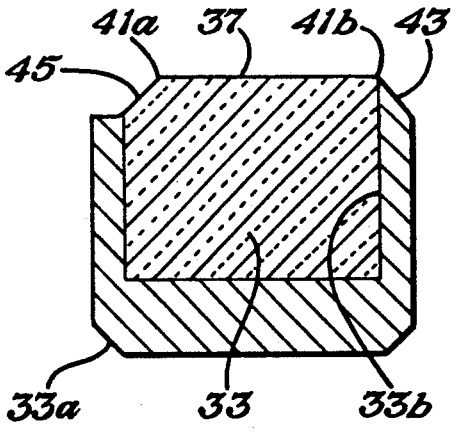
FIG. 4 is an enlarged, longitudinal section of a gage insert in accordance with the present invention.

FIG. 4 shows yet another embodiment of the gage insert of the present invention. In this embodiment, the cutting end 35 of the insert 31 is a cylinder of super-hard, abrasion-resistant material. The body 33 of the insert 31 is a cylinder of hard, fracture-tough material, having a cylindrical socket 33*b* enclosing the cutting end cylinder 35. Such an insert may be formed by sintering the two materials together, brazing the cutting end 35 into the socket 33*b* of the insert body 33, or other methods known in the art. A planar bevel 45 is formed on the cutting end 35 of the gage insert 31, intersecting the face 37 of the cutting end 35 to define a first cutting edge 41*a*. The first cutting edge 41*a* thus is formed of the super-hard, abrasion-resistant material of the cutting end cylinder 35. A second cutting edge 41*b* is formed by the intersection of a circumferential bevel about the body of the insert and the face 37 of the cutting end 35. The second cutting edge 41*b* thus is formed of the hard, fracture-tough material.

It will be appreciated that a variety of cutting edges formed of materials having various mechanical properties may be formed on a gage insert in accordance with this invention. Apart from the number and composition of the cutting edges 41, 41*a*, 41*b*, the dimensions of the bevels that define the cutting edges are of significance in the proper operation of the gage insert 31 of the present invention. For reasons that will become apparent in the discussion of the operation of the invention, the bevel angle $\theta$ is of importance. It has been found that a bevel angle $\theta$ of 45 degrees functions quite satisfactorily. Likewise, the depth and width of the bevel 43, 45 are important to the proper function of the gage insert 31. It has been determined that a bevel depth $d_1$ of at least 0.010 inch, in combination with a bevel angle $\theta$ of 45 degrees, produces a satisfactorily functioning gage insert. Because the bevel angle $\theta$ is 45 degrees, the depth $d_1$ and width of the bevel are the same. For another bevel angle $\theta$, the depth $d_1$ and width would not be equal, but the bevel depth $d_1$ should be selected to be at least 0.010 inch. The bevel described herein should be distinguished from bevels formed by standard manufacturing operations such as "breaking sharp edges or corners." The bevel resulting from such operations typically resembles a radius, and therefore is not capable of forming the cutting edge 41 of the present invention.

Figure 5:
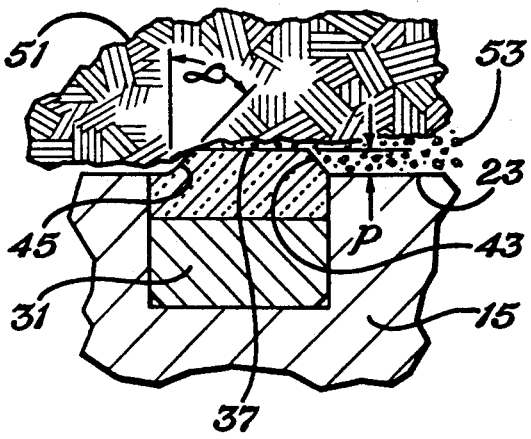
FIG. 5 is an enlarged, fragmentary view, in longitudinal section, of a gage insert of the present invention in shear-cutting engagement with the sidewall of the borehole.

FIG. 5 illustrates, in longitudinal section, an embodiment of the gage insert 31 in operation. The geometry and dynamics of the cutting action of earth-boring bits is extremely complex, but the operation of the gage insert 31 of the present invention is believed to be similar to that of a metal-cutting tool. As the cutter 15 rotates along the bottom of the borehole, the gage surface 23 of each cutter 15 contacts the sidewall 51 of the borehole. Because the gage surface 23 contacts the sidewall 51 of the borehole, likewise the protruding gage insert 31 contacts the sidewall 51 of the borehole. The cutting edge 41 of the gage insert 31 shearingly cuts into the material of the sidewall 51 of the borehole. The bevel 45 serves as a cutting or chip-breaking surface that causes shear stress in the material of the borehole sidewall 51, thus shearing off fragments or chips 53 of the borehole material. The substantially flat face 37 of the insert 31 remains at least partially in contact with the sidewall 51 of the borehole, and thus is subject to abrasive wear during operation. Wear-resistance of the face 37 is enhanced because the surface area of the face 37 that is in contact with the sidewall is maximized (the area is very nearly equal to the cross-sectional area of the generally cylindrical insert body 33). An insert design having a smaller contact surface area of the face 37 would not have adequate wear-resistant characteristics.

Significant in the proper operation of the gage inserts 31 of the present invention are the dimensions of the cutting edge 41, 41*a*, 41*b* and bevel 43, 45. In cutting the sidewall 51 of the borehole, the bevel angle $\theta$ defines a rake angle $\alpha$ with respect to the portion of the borehole sidewall 51 being cut. It is believed that the rake angle $\alpha$ must be negative (such that the cutting surface leads the cutting edge 41) to avoid high friction and the resulting heat buildup, which can cause rapid failure of the gage insert 31. The bevel angle $\theta$, which defines and is equal to, the rake angle $\alpha$, may be chosen from a range between 0 and 90 degrees. The choice of bevel and rake angle $\theta$, $\alpha$ depends upon the cutting action desired: at a high rake angle $\alpha$ (90 degrees, for instance), there is no cutting edge, and thus no shearing action; at a low rake angle $\alpha$ (0 degrees, for instance) shearing action is maximized, but is accompanied by high friction and transient shock loading of the insert 31, which can cause insert failure. It is believed that an intermediate rake angle, in the range between 15 and 60 degrees, provides a satisfactory compromise between the cutting action of the insert 31 and insert operational life.

Again, because the cutting dynamics of rolling cone earth-boring bits are complicated, the exact cutting action of the gage insert 31 is not fully understood. It is believed that providing an at least partially circumferential cutting edge (41 and 41*b* in FIGS. 2 and 3) having a circumferential bevel 43 will permit the cutting edge 41, 41*b* to shearingly contact the sidewall 51 of the borehole notwithstanding geometric peculiarities of the earth-boring bit design or of the borehole being drilled. Providing a planar cutting edge 41*a*, in addition to the partially circumferential cutting edge 41*b*, is thought to provide a more efficient cutting edge at a point on the insert 31 that is believed to contact the sidewall of the borehole 51 most frequently. Such a planar cutting edge is believed to be more effective at removing borehole sidewall 51 material (i.e. takes a bigger bite) than other types of edges.

The face 37 of the insert 31 should extend a distance p from the gage surface 23 during drilling operation. Such protrusion enhances the ability of the cutting edge 41, 41*a*, 41*b*, to shearingly engage the borehole sidewall 51. During drilling operation in abrasive formations, the gage surface 23 will be eroded away, increasing any distance p the face 37 protrudes or extends form the gage surface 23. If the cutting face 37 extends much further than 0.075 inch from the gage surface 23, the insert 31 may experience an unduly large bending stress, which may cause the insert 31 to break of fail prematurely. Therefore, the face 37 should not extend a great distance p from the gage surface 23 at assembly and prior to drilling operation. The face may be flush with the gage surface 23 at assembly, or preferably may extend a distance p of a minimum of 0.010 inch.

At least one cutting edge 41, 41*a*, 41*b*, of the gage insert 31 must be formed of the super-hard, abrasion-resistant material (as discussed above) to prevent the cutting edge from rapidly being eroded by the abrasive materials encountered in the borehole. It has been found that gage inserts formed of softer materials cannot maintain the cutting edge 41, 41*a*, 41*b*, required for the operation of the gage insert 31 of the present invention. Provisions of an insert body 33 formed of a hard, fracture-tough material such as cemented tungsten carbide provides a shock absorbing mass to absorb the shock loads that the super-hard, abrasion-resistant material is incapable of sustaining by itself.

An advantage of the improved gage insert of the present invention is that earth-boring bits equipped with such inserts have both superior gage-holding ability and superior directional drilling steerability compared with bits having prior art gage inserts.

Although the invention has been described with reference to specific embodiments, it will be apparent to those skilled in the art that various modifications may be made without departing from the scope of the invention described herein.

We claim:

1. In a rolling cutter of an earth-boring bit having a gage surface for contacting a sidewall of a borehole as the cutter rotates about its axis and rolls over the bottom of the borehole, the gage surface having a plurality of gage inserts secured by interference fit in sockets formed in the gage surface, an improved gage insert comprising:

at least one of the gage inserts having an elongated cylindrical body inserted in a selected socket in the gage surface, the body formed of a hard, fracture-tough material;

the gage insert having a cutting end adapted to extend, during drilling, a selected distance from the gage surface, the cutting end formed from a super-hard, abrasion-resistant material;

the cutting end of the gage insert having a substantially flat wear-resistant face substantially normal to a longitudinal axis of the body of the insert;

at least one cutting surface connecting the face and the body of the gage insert at a selected angle to define at least one cutting edge to shear the sidewall of the borehole; and the selected angle of each cutting surface defining a negative rake angle with respect to a portion of the sidewall of the borehole being sheared.

2. The improved gage insert according to claim 1 wherein the cutting end of the gage insert extends at least 0.010 inch from the gage surface of the rolling cutter during drilling operation.

3. The improved gage insert according to claim 1 wherein the at least one cutting surface extends from the abrasion-resistant face toward the gage surface at least 0.010 inch, measured parallel to the longitudinal axis of the body of the gage insert.

4. The improved gage insert according to claim 1 wherein the cutting surface connects the face and the body of the gage insert at an angle between a maximum angle of 60 degrees and a minimum angle of 15 degrees measured relative to a longitudinal axis of the elongated cylindrical body of the gage insert.

5. The improved gage insert according to claim 1 wherein:

a first at least one cutting surface is formed from a super-hard, abrasion-resistant resistant material; and a second at least one cutting surface is formed from a hard, fracture-tough material.

6. The improved gage insert according to claim 1 wherein:

the hard, fracture-tough material is cemented tungsten carbide; and the super-hard, abrasion-resistant material is polycrystalline diamond.

7. In a rolling cutter of an earth-boring bit having a gage surface for contacting a sidewall of a borehole as the cutter rotates about its axis and rolls over the bottom of the borehole, the gage surface having a plurality of gage inserts, each gage insert secured by interference fit into a socket formed in the gage surface, an improved gage insert comprising:

at least one of said gage inserts having an elongated cylindrical body partially inserted in a selected socket in the gage surface, the body formed of a hard, fracture-tough material;

the gage insert having a cutting end extending a selected distance from the gage surface, the cutting end formed of a super-hard, abrasion-resistant material;

the cutting end of said insert having a substantially flat abrasion-resistant face substantially normal to a longitudinal axis of the body of the insert;

a generally conical circumferential cutting surface connecting the face and the body of the gage insert at a selected angle to define an arcuate cutting edge to shear the sidewall of the borehole; and the selected angle of the cutting surface defining a negative rake angle with respect to a portion of the sidewall of the borehole being sheared.

8. The improved gage insert according to claim 7 wherein the cutting end of the gage insert extends at least 0.010 inch from the gage surface of the rolling cutter.

9. The improved gage insert according to claim 7 wherein the cutting surface extends from the abrasion resistant face toward the gage surface at least 0.010 inch, measured parallel to a longitudinal axis of the elongated cylindrical body of the gage insert.

10. The improved gage insert according to claim 7 wherein the cutting surface connects the face and the body of the gage insert at an angle between a maximum angle of 60 degrees and a minimum angle of 15 degrees relative to the longitudinal axis of the elongated cylindrical body of the gage insert.

11. The improved gage insert according to claim 7 wherein:

the hard, fracture-tough material is cemented tungsten carbide; and the super-hard, abrasion-resistant material is polycrystalline diamond.

12. In a rolling cutter of an earth-boring bit having a gage surface for contacting a sidewall of a borehole as the cutter rotates about its axis and rolls over the bottom of the borehole, the gage surface having a plurality of gage inserts, each gage insert secured by interference fit in a socket formed in the gage surface, an improved gage insert comprising:

at least one of said gage inserts having an elongated cylindrical body partially inserted into a selected socket in the gage surface, the body formed of a hard, fracture-tough material;

the gage insert having a cutting end extending a selected distance from the gage surface, the cutting end formed of a super-hard, abrasion-resistant material;

the cutting end of said insert having a substantially flat abrasion-resistant face substantially normal to a longitudinal axis of the body of the insert;

a generally conical partially circumferential cutting surface connecting the face and the body of the gage insert at a selected angle to define an arcuate cutting edge to shear the sidewall of the borehole;

a substantially planar cutting surface connecting the face, the body, and the generally conical first cutting surface of the gage insert at a selected angle to define a substantially linear cutting edge to shear the sidewall of the borehole; and the selected angle of each cutting surface defining a negative rake angle with respect to a portion of the sidewall of the borehole being sheared.

13. The improved gage insert according to claim 12 wherein the cutting end of the gage insert extends at least 0.010 inch from the gage surface of the rolling cutter.

14. The improved gage insert according to claim 12 wherein the at least one cutting surface extends from the abrasion resistant face toward the gage surface at least 0.010 inch, measured parallel to a longitudinal axis of the elongated cylindrical body of the gage insert.

15. The improved gage insert according to claim 12 wherein the cutting surface connects the face and the body of the gage insert at an angle between a maximum angle of 60 degrees and a minimum angle of 15 degrees measured relative to the longitudinal axis of the elongated cylindrical body of the gage insert.

16. The improved gage insert according to claim 12 wherein:

the hard, fracture-tough material is cemented tungsten carbide; and the super-hard, abrasion-resistant material is polycrystalline diamond.

* * * * *